United States Patent [19]

Yamanari et al.

[11] Patent Number: 4,976,197

[45] Date of Patent: Dec. 11, 1990

[54] REVERSE SIDE PRINTING DEVICE EMPLOYING SHEET FEED CYLINDER IN SHEET-FED PRINTER

[75] Inventors: Hiroshi Yamanari; Nobuhiko Fujisawa, both of Hiroshima, Japan

[73] Assignee: Ryobi, Ltd., Hiroshima, Japan

[21] Appl. No.: 504,078

[22] Filed: Apr. 4, 1990

Related U.S. Application Data

[63] Continuation-in-part of Ser. No. 225,642, Jul. 27, 1988, abandoned, which is a continuation of Ser. No. 44,547, May 1, 1987, abandoned.

[51] Int. Cl.[5] ..... B41F 7/12; B41F 7/06

[52] U.S. Cl. ..... 101/137; 101/144; 101/177; 101/184; 101/231

[58] Field of Search ..... 101/136, 137, 140, 141, 101/142, 144, 145, 177, 183, 184, 218, 229, 231

[56] References Cited

U.S. PATENT DOCUMENTS

| | | | |
|---|---|---|---|
| 338,666 | 3/1886 | Hawkins | 101/136 |
| 403,001 | 5/1889 | Sutherland | 101/180 |
| 452,693 | 5/1891 | Crowell | 101/180 |
| 510,193 | 12/1893 | Scott | 101/180 |
| 592,887 | 11/1897 | Scott | 101/179 |
| 845,586 | 2/1907 | Sheehan | 101/141 |
| 1,459,312 | 6/1923 | Pritchard | 101/144 X |
| 2,002,814 | 5/1935 | Harrold | 101/136 |
| 2,100,852 | 11/1937 | Jacobson | 101/137 |
| 2,360,340 | 10/1944 | Harris | 101/231 X |
| 2,540,690 | 2/1951 | Pritchard | 101/231 X |
| 2,542,867 | 2/1951 | Harrold | 101/137 |
| 2,789,499 | 4/1957 | Dietrich | 101/229 |
| 3,112,695 | 12/1963 | Seel | 101/137 |
| 3,525,304 | 8/1970 | Norton et al. | 101/177 X |
| 4,321,869 | 3/1982 | Jeschke et al. | 101/136 |
| 4,587,897 | 5/1986 | Fischer | 101/137 |

*Primary Examiner*—Clifford D. Crowder

*Attorney, Agent, or Firm*—Sughrue, Mion, Zinn, Macpeak & Seas

[57] ABSTRACT

A double-sided printing machine in which two sides of fed sheets are printed by two adjacent impression cylinders, each with their own plate and blanket cylinders. Thereby, the first impression cylinder acts as a sheet feed cylinder for the second impression cylinder.

1 Claim, 2 Drawing Sheets

REVERSE SIDE PRINTING DEVICE EMPLOYING SHEET FEED CYLINDER IN SHEET-FED PRINTER this is a continuation-in-part of application Ser. No. 07/225,642, filed July 27, 1988, which is a continuation of application Ser. No. 07/044,547, filed May 1, 1987, both now abandoned.

BACKGROUND OF THE INVENTION

1. Field of the Invention

The present invention relates to a reverse side printing device employing a sheet feed cylinder and provided in a sheet-fed double-sided printing machine.

2. Background of the Invention

In a conventional sheet-fed double-sided printing machine, a sheet is conveyed between an obverse (front) side printing blanket and a reverse side printing blanket so that both the obverse and reverse sides of the sheet are printed at the same time. Since the printing machine is used exclusively for printing both the sides of the sheet, the printer is not capable of printing only one side of the sheet. Since the blankets are rubber cylinders, dragged printing is caused so that the sharpness of a printed net pattern or a printed point pattern is low.

In another conventional sheet-fed double-sided printing machine, the obverse side of a sheet is first printed, and the sheet is then turned over by an inversion mechanism to print the reverse side of the sheet. However, the switching operation of the inversion mechanism is inconvenient, and the accuracy of the printing is lower than a sheet-fed single-sided printing machine.

SUMMARY OF THE INVENTION

The present invention was made in consideration of the above-described problems.

Accordingly, this object of the present invention is satisfied by a reverse side printing device in which a sheet feed cylinder is provided upstream (as to the direction of sheet feeding) of the blanket of an obverse side printing section. The sheet feed cylinder feeds a sheet from a sheet feed section to the obverse side printing section. This sheet feed cylinder is built to function both as a sheet feed cylinder and as a reverse side impression cylinder to constitute an element of a reverse side printing section. Therefore, reverse side printing can be performed at a desired time without degrading the effect and accuracy of obverse side printing and without making a switching operation or the like inconvenient.

In the reverse side printing device provided according to the invention in a sheet-fed printing machine, the sheet feed cylinder provided upstream of the blanket of the obverse side printing section is built as both the sheet feed cylinder and reverse side impression cylinder. The reverse side printing device includes a rotating cylinder (sheet feed cylinder) serving as a sheet feed cylinder and a reverse side impression cylinder, a plate cylinder, a blanket cylinder, an ink section, and a water section. The reverse side printing device is positioned between the sheet feed section and a main impression cylinder 6. The blanket cylinder and the plate cylinder are sequentially and removably disposed at the sheet feed cylinder and the reverse side impression cylinder printing blanket to constitute the reverse side printing section. As a result, the above-described problems are solved.

This reverse side printing section is simply and cheaply constituted.

Since the obverse side of the sheet is printed by the obverse side printing section after the reverse side of the sheet is printed by the reverse side printing section, the effect and accuracy of the printing of the obverse side of the sheet are not degraded by the reverse side printing section.

Since the reverse side printing can be performed at a desired time without effecting a switching operation or the like, the operating quality of the reverse side printing device is high.

DETAILED DESCRIPTION OF PREFERRED EMBODIMENTS

Figure 1:
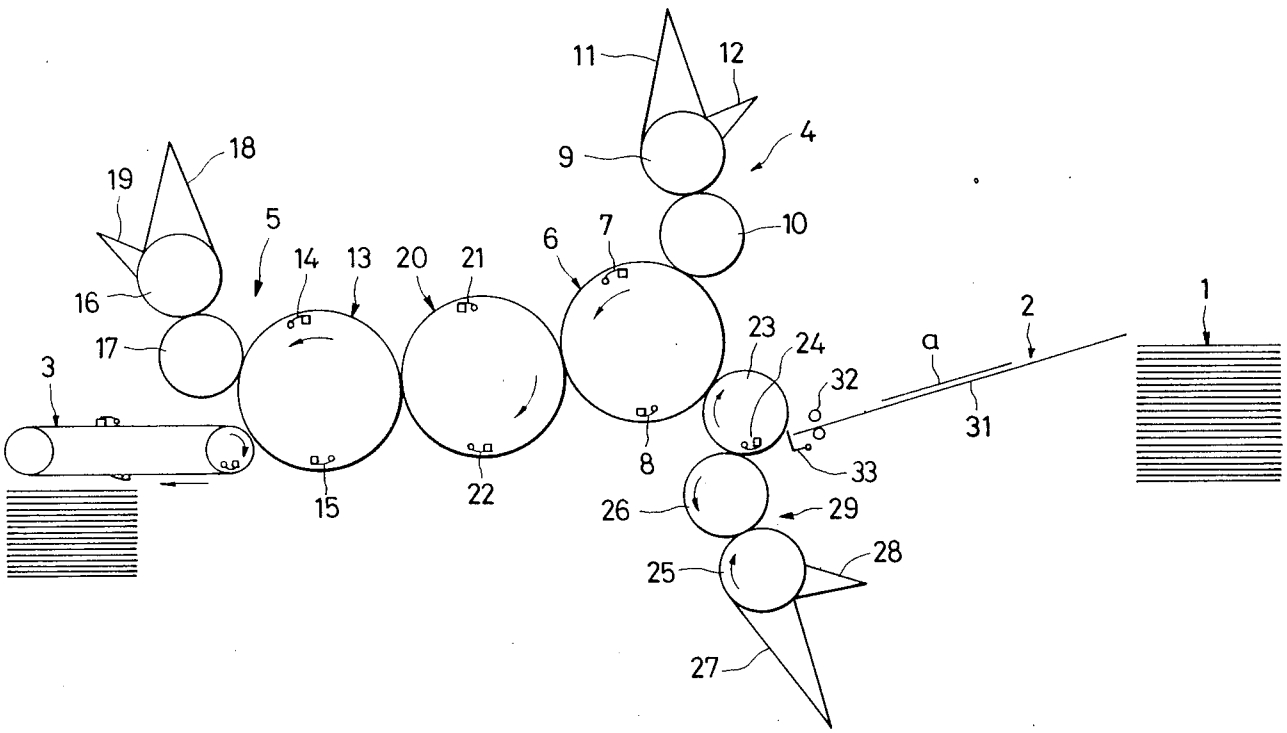
FIG. 1 shows a schematic view of an example of the cylinder arrangement of an embodiment of the present invention, which is a reverse side printing device employing a sheet cylinder (a rotating cylinder) and provided in a sheet-fed printing machine.

An embodiment of present invention is hereafter described in detail with reference to FIG. 1 showing a sheet-fed double-sided printing machine which prints one (obverse) side of a sheet in a plurality of colors. Shown in FIG. 1 are a sheet feed section 1, a sheet inserting section 2 and sheet discharge section 3. A first printing section 4 and third printing section 5 are sequentially provided between the sheet inserting section 2 and the sheet discharge section 3 to print the obverse (front) side of the sheet a.

The first printing section 4 includes a main impression cylinder 6 provided with a conventional sheet engaging means (not shown in the drawing) having sheet grabbing claws 7 and 8 or the like in symmetric positions at the peripheral surface of the rotating main impression cylinder 6. A plate cylinder 9 has an outside diameter equal to half of that of the impression cylinder 6. A blanket cylinder 10 is removably disposed adjacent the impression cylinder 6 and the plate cylinder 9 and has an outside diameter equal to half of that of the impression cylinder 6. An ink section 11 and a water section 12 are provided next to the plate cylinder 9. One-color printing is performed through the use of the blanket cylinder 10 and the impression cylinder 6 at the first printing section 4 on the obverse side of sheet.

The third printing section 5 is similar to the first printing section 4 and includes another impression cylinder 13 whose outside diameter is equal to that of the impression cylinder 6 of the first printing section 4 and which is provided with a conventional sheet grabbing claws 14 and 15 or the like in symmetric positions at the peripheral surface of the cylinder 13. A plate cylinder 16 has an outside diameter equal to half of that of the cylinder 13. A blanket cylinder 17 has an outside diameter equal to half of that of the impression cylinder 13 and is disposed between the impression cylinder 13 and plate cylinder 16. An ink section 18 and a water section 19 are provided next to the plate cylinder 16 and removable from impressive cylinder 13.

A transferring cylinder 20 transfers the sheet a from the first impression cylinder 6 to the third impression cylinder 13 and is located between these cylinders 6 and 13. The outside diameter of the transferring cylinder 20 is equal to that of each of the impression cylinders 6 and 13. The transferring cylinder 20 is provided with a conventional sheet engaging means (not shown in the drawing) having sheet grabbing claws 21 and 22 or the like in symmetric positions at the peripheral surface of the transferring cylinder.

A combined sheet feed cylinder 23 and reverse side impression cylinder feeds the sheet a to the first printing section 4 and is provided upstream (as to the direction of the feed of the sheet of the impression cylinder 6 of the first printing section 4 so that the sheet feed cylinder 23 is located between the sheet inserting section 2 and the impression cylinder 6. Cylinder 23 is built as a sheet feed cylinder and reverse side, second impression cylinder for printing the reverse side of the sheet a. The outside diameter of the sheet feed cylinder and reverse side impression cylinder 23 is equal to a half of that of the first impression cylinder 6. The paper feed cylinder and reverse side impression cylinder 23 is provided with a conventional paper engaging means (not shown in the drawing) having a sheet engaging claw 24 or the like in a notch (not shown in the drawing) provided in the peripheral surface of the sheet feed cylinder and reverse side impression cylinder 23. The paper engaging means relays the sheet a to the impression cylinder 6.

A plate cylinder 25 and a blanket cylinder 26, each of which has the same outside diameter as the sheet feed cylinder and reverse side impression cylinder 23, are provided so that the blanket cylinder is removable from the sheet feed cylinder and reverse side impression cylinder 23 and from the plate cylinder 25.

The rotating cylinder 23 performs both as an impression cylinder for the second (reverse side) printing section and as a paper feed cylinder for the first (obverse side) printing section. In the device of the present invention, the plate cylinder 25 is provided under a horizontal plane including a rotating axis of the rotating cylinder 23, and on a paper feeding side of a vertical plane including the rotating axis of the rotating cylinder 23. Accordingly, it is easy to replace the plate cylinder 25 since the replacement of the cylinder is accomplished merely by lifting the fee board 31. Further, it is easy to clean the blanket cylinder 26. Furthermore, according to the apparatus of the invention thus constructed, the apparatus can be manufactured small in size. Moreover, the reverse side printing apparatus of the present invention can be obtained by modifying, at small expense, a conventional two-color printing apparatus having no second (reverse side) printing section. Therefore, the apparatus of the invention can be manufactured simple in construction and low in manufacturing cost.

An ink section 27 and a water section 28 are provided next to the plate cylinder 25. As a result, a second side printing section 29 is constituted. The blanket cylinder 26 is supported to the right and left frames of the printing machine by a conventional means so that the blanket cylinder can be swung between an operative position and a removed position.

Figure 2:
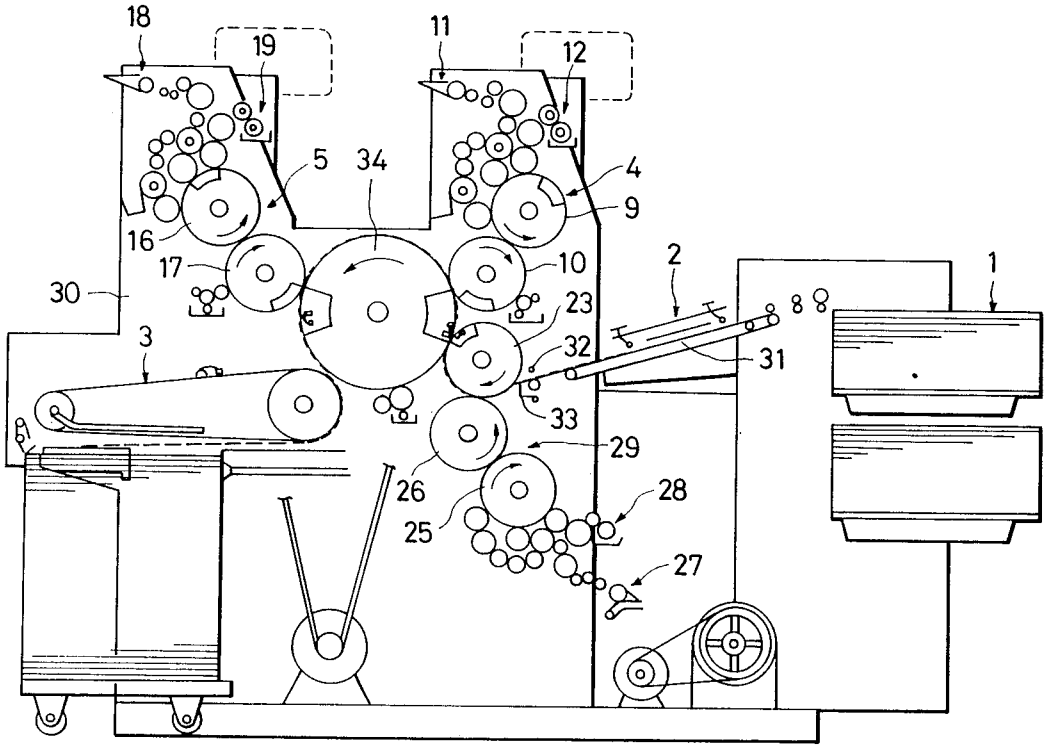
FIG. 2 shows a schematic view of an entire sheet-fed printing machine including a reverse side printing device which is another embodiment of the present invention.

FIG. 2 shows another embodiment of the present invention, in which the impression cylinders 6 and 13 of the first and a third printing sections 4 and 5 are combined into a single impression cylinder 34 to serve also as a transferring cylinder. In the other respects, the embodiments shown in FIG. 1 and 2 are similar to each other.

Shown in both FIGS. 1 and 2 are a feed board 31, a pair of feed-in rollers 32 and a sheet contact member 33.

In each of the embodiments, the sheet a is conveyed from the sheet feed section 1 onto the feed board 31 of the sheet inserting section 2 and is then pretransferring registered by the contact member 33. It is conveyed by the feed-in rollers 32, engaged with the sheet engaging claw 24 of the sheet feed cylinder and reverse side impression cylinder 23, conveyed into the area between the sheet feed cylinder and reverse side impression cylinder 23 and the blanket cylinder 26 and is brought into contact with the blanket cylinder 26 so that the reverse side of the sheet a is printed. After that, the sheet engaging claw 24 is opened so that the sheet a is released from the sheet feed cylinder and reverse side impression cylinder 23. The sheet a is then engaged with the sheet engaging claw 8 of the first impression cylinder 6 of the first printing section 4 so that the sheet a is transferred to the impression cylinder 6. At that time, the sheet a, in the embodiment shown in FIG. 1 is carried the impression cylinder 6 so that the obverse side of the sheet a is printed with a first color as the sheet a is brought into contact with the blanket cylinder 10. Subsequently, the sheet a is moved from the impression cylinder 6 to the transferring cylinder 20 with sheet a engaged with claw 22 of cylinder 20 and then carried to the second impression cylinder 13 of the third printing section 5 where it attaches these in claw 14, so that the obverse side of the sheet is printed with a second color as the sheet 9 is brought into contact with the blanket cylinder 17. In the second embodiment, the two impression cylinders 6 and 13 and the transferring cylinder 20 are the same physical cylinder 34 so that there is no transfer of the sheet a therebetween. After that, the sheet a is moved out by the sheet discharge section 3.

Although the above-described embodiments are for a double-sided printer which prints the obverse side of the sheet in two colors, the present invention can be also applied to a double-sided printing machine which prints the obverse side of the sheet in more than two colors, a double-sided printing machine which prints the obverse side of the sheet in one color, and so forth.

What is claimed is:

1. A double-sided sheet printing machine, comprising:

a sheet feeding section for feeding sheets of paper;

a first printing section for printing a first side of said sheets and including a first impression cylinder;

a rotating cylinder forming a combined sheet feed and impression cylinder functioning as a sheet feed cylinder for said first printing section and a second impression cylinder for a second printing section, said rotating cylinder having a rotating axis and being disposed between said sheet feeding section and said first printing section;

a plate cylinder disposed beneath a horizontal plane including said rotating axis of said rotating cylinder, and on a paper feeding side of a vertical plane including said rotating axis of said rotating cylinder;

a blanket cylinder receiving an image from said plate cylinder and transferring said image to said second side of said sheets disposed on said rotating cylinder, whereby said second side of said sheets is printed, and a third printing section downstream of said first printing section, and receiving sheets from said first printing section, said third printing section printing on said first side of said sheets, at least said blanket cylinder being shiftable into and out of contact with said rotating cylinder, and wherein said combination of said rotating cylinder, said blanket cylinder and said plate cylinder constitute said second printing section for printing on said second side of said sheets prior to a feed of said sheets by said rotating cylinder to said first printing section first impression cylinder.

* * * * *